US005803633A

United States Patent [19]

Akahane et al.

[11] Patent Number: 5,803,633

[45] **Date of Patent: *Sep. 8, 1998**

[54] PRINTER FOR FEEDING PRINTING SHEETS OF DIFFERENT THICKNESSES

[75] Inventors: Takashi Akahane; Shigeki Hayashi; Kazuo Saitou; Kiyoto Komuro, all of Nagano, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 652,076

[22] Filed: May 23, 1996

[30] Foreign Application Priority Data

May 24, 1995 [JP] Japan ..... 7-149637

[51] Int. Cl.[6] ..... B41J 13/10

[52] U.S. Cl. ..... 400/642; 400/639.1; 400/645

[58] Field of Search ..... 400/636, 636.1, 400/638, 639.1, 642, 645

[56] References Cited

U.S. PATENT DOCUMENTS

| | | | |
|---|---|---|---|
| 4,567,491 | 1/1986 | Lawrence | 400/638 |
| 5,244,295 | 9/1993 | Terashima et al. | 400/645 |
| 5,320,437 | 6/1994 | Malke et al. | 400/642 |
| 5,368,290 | 11/1994 | Nanba | 271/273 |
| 5,441,354 | 8/1995 | Broder et al. | 400/638 |
| 5,564,847 | 10/1996 | Patrick et al. | 400/642 |

FOREIGN PATENT DOCUMENTS

| | | |
|---|---|---|
| 0581276A2 | 2/1994 | European Pat. Off. . |
| 3501324A1 | 7/1986 | Germany . |
| 9315236.1 | 2/1994 | Germany . |
| 59-222372 | 12/1984 | Japan . |
| Sho. 63-144063 | 6/1988 | Japan . |
| 63-254082 | 10/1988 | Japan . |
| 04141426 | 5/1992 | Japan . |
| 04144848 | 5/1992 | Japan . |

*Primary Examiner*—John S. Hilten

*Attorney, Agent, or Firm*—Stroock & Stroock & Lavan LLP

[57] ABSTRACT

A printer for feeding printing sheets of different thicknesses including a sheet feeding roller 30 adapted to convey a printing sheet P. A pinch roller having a shaft 40*a* is provided and adapted to press a printing sheet against sheet feeding roller. A supporting member 41 is provided for rotatably supporting pinch roller 40 through shaft 41. An urging member 45 is provided for applying the pressing force through the supporting member to the pinch roller. A guide member 46, discrete from supporting member 41, is positioned by shaft 40*a* of pinch roller 30, and adapted to lead the front edge of the printing sheet to the nipping region of sheet feeding roller 30 and pinch roller 40.

8 Claims, 4 Drawing Sheets

PRINTER FOR FEEDING PRINTING SHEETS OF DIFFERENT THICKNESSES

BACKGROUND OF THE INVENTION

1. Field of the Invention

This invention relates generally to a printer, and in particular, to a printer which smoothly feeds a printing sheet irrespective of its thickness.

2. Related Art

A conventional printer such as that described in Japanese Patent Application No. 144063/1988, and as shown in FIG. 5, comprises: a sheet feeding roller 1 adapted to feed a printing sheet P; a pinch roller 2 adapted to press a printing sheet against sheet feeding roller 1; a supporting member 3 which rotatably supports pinch roller 2 through a shaft 2*a*; and an urging member 4 (e.g. a spring) for applying a pressing force to pinch roller 2 through supporting member 3. Sheet feeding roller 1 is generally a driving roller, and the pinch roller 2 is pushed against sheet feeding roller 1 and is driven thereby. Supporting member 3 is swingably supported by a shaft 3*b* to serve as a guide for a printing sheet. Urging member 4 is positioned between supporting member 3 and a frame 5, thus urging supporting member 3 and pinch roller 2 in the direction of the arrow F. That is, pinch roller 2 is pressed against sheet feeding roller 1.

Printing sheet P is supplied by a sheet supplying unit (not shown). After printing sheet P is guided by supporting member 3, its front end Pa is led to the nipping region of sheet feeding roller 1 and pinch roller 2 as indicated by the arrow a. When the front end Pa of printing sheet P enters the nipping region, the sheet conveying force of sheet feeding roller 1 acts on sheet P so that sheet P is conveyed while being held between pinch roller 2 and sheet feeding roller 1. During conveyance, characters, images and the like are printed on printing sheet P with a printing head (not shown).

Based on the above construction, in order to feed a printing sheet positively and accurately, pressing force F of pinch roller 2 applied to sheet feeding roller 1 must be increased so that the sheet conveying force of sheet feeding roller 1 is positively applied to the printing sheet. However, the increase of pressing force F causes the following difficulties. When pressing force F is increased, the contact force of shaft 2*a* of pinch roller 2 and bearing 3*a* of supporting member 3 is also increased. As a result, if the structure is being used for a long time, bearing 3*a* wears out. Therefore, the periphery of bearing 3 of supporting member 3 is displaced towards sheet feeding roller 1 causing a distance C between supporting member 3 and sheet feeding roller 1 to decrease. Therefore, when a printing sheet P is relatively large in thickness, such as an envelope or OHP sheet, front end Pa of printing sheet P is clamped by sheet feeding roller 1 and supporting member 3 before reaching the nipping region of sheet feeding roller 1 and pinch roller 2. Thus, it is impossible to positively and smoothly convey a printing sheet relatively large in thickness.

On the other hand, if the wear of bearing 3*a* is taken into account during assembly so that distance C is increased to avoid the problems associated with thick sheets, a different problem occurs. In particular, when the printing sheet is relatively small in thickness such as an ordinary sheet, distance C is too large for the printing sheet causing front end Pa to vibrate. As a result, it is impossible to smoothly and positively feed the printing sheet.

Accordingly, it is desirable to provide a printer which feeds a printing sheet smoothly irrespective of its thickness.

SUMMARY OF THE INVENTION

Generally speaking, in accordance with the invention, a printer is provided for printing information onto recording media having different thicknesses. The printer includes at least one sheet feeding roller for conveying the recording medium through the printer. At least one print roller is provided for pressing the recording medium against the sheet feeding roller. A nipping region is formed substantially where the sheet feeding roller meets the pinch roller. The pinch roller is rotatably mounted about a shaft. At least one supporting member is provided for substantially supporting the pinch roller. At least one guide member is provided and positioned by the shaft of the pinch roller and discrete from the supporting member. The guide member guides a leading edge of the recording medium to the nipping region.

Accordingly, it is an object of the invention to provide an improved printer which accurately and smoothly feeds printing sheets of different thicknesses therethrough.

Another object of the invention is to provide a printer having a guide member which is discrete from the supporting member of the pinch roller.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
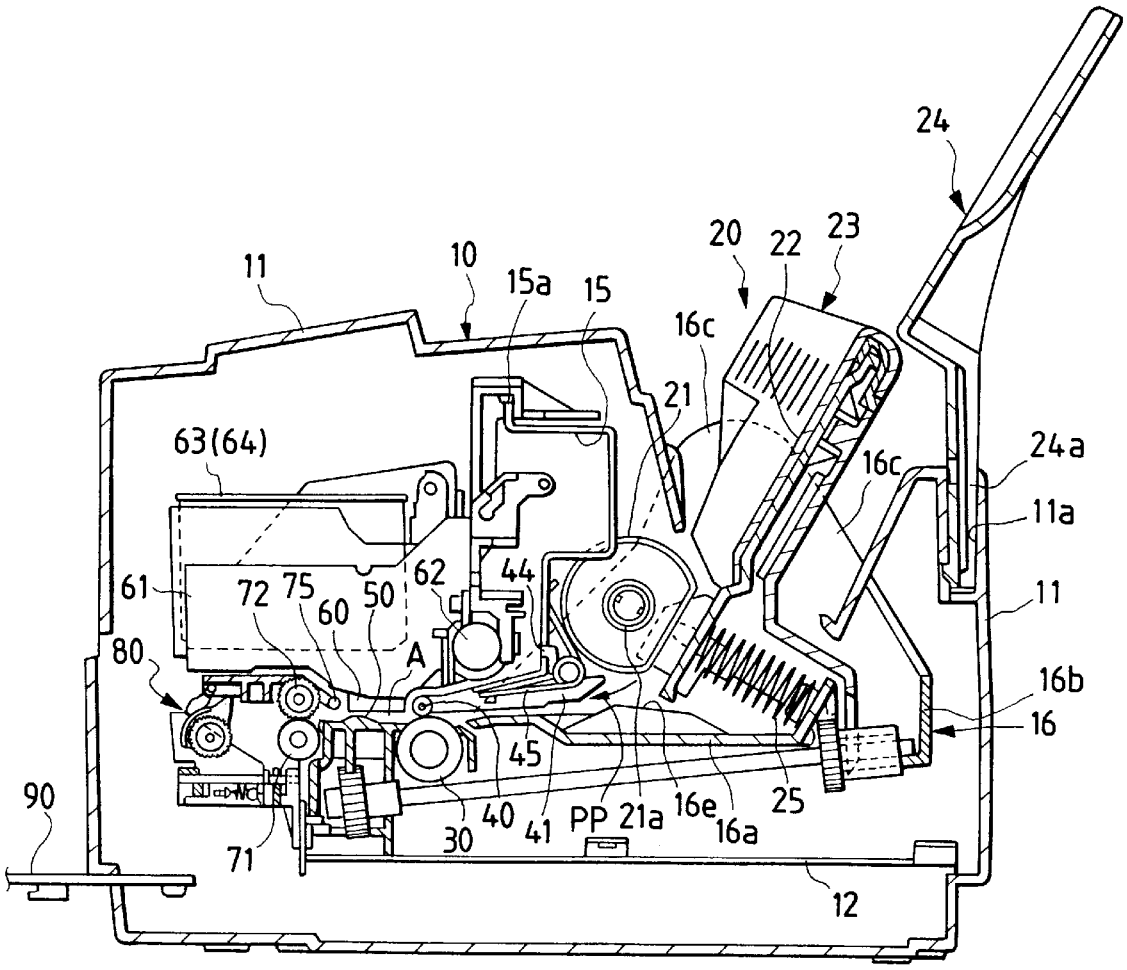
FIG. 1 is a cross-sectional side elevational view of the internal structure of an ink jet printer constructed in accordance with the invention.

Referring now to FIG. 1, a printer body generally indicated at 10, and constructed in accordance with the preferred embodiment of the invention is provided. Printer body 10 includes a printer body casing 11 and an automatic sheet supplying unit 20 disposed in printer body 10. At least one sheet feeding roller 30 is mounted within printer body 10 downstream of sheet supplying unit 20 along a feed path PP. A pinch roller 40 is pressed against the sheet feeding rollers 30 and is driven by sheet feeding roller 30. A regulating member 50 adapted to guide the rear surface of a printing sheet P is disposed downstream of rollers 30, 40 along feed path PP. A carriage 61 mounted within casing 11, supports an ink jet head 60 thereon to jet ink droplets onto the printing sheet. A guide roller 75 downstream of ink jet head 60 guides the sheet along feed path PP. A pair of sheet discharging rollers 71 and 72 are disposed between guide roller 75 and a paper discharging section 80. In front of printer body 10, a sheet discharging tray 90 is provided on which discharged sheets are stacked.

Figure 3:
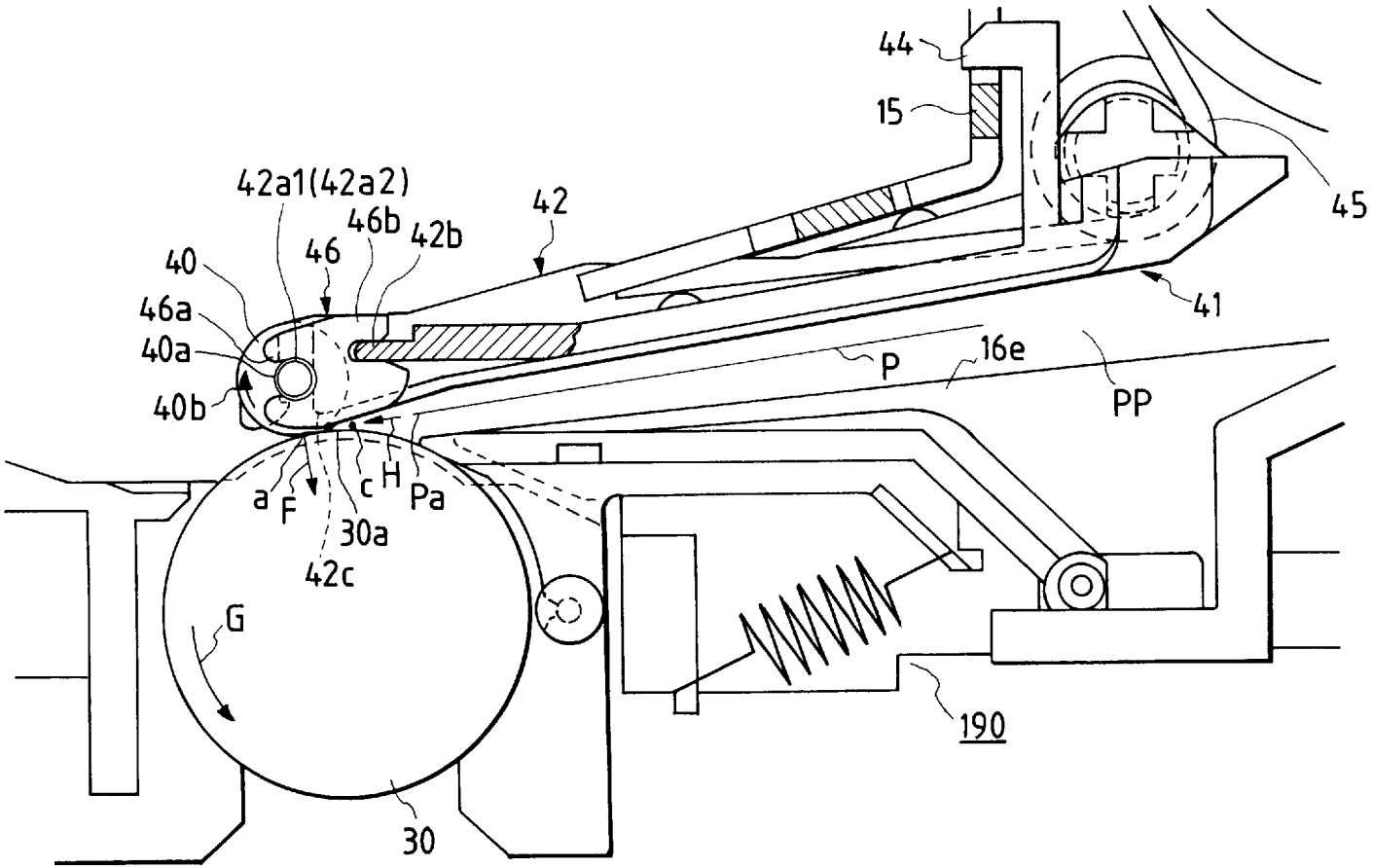
FIG. 3 is an enlarged cross-sectional view taken along line III—III of FIG. 4.

A printing sheet P, supplied from the automatic sheet supplying unit 20, is conveyed to roller 30 along sheet feed path PP. Sheet feed path PP is curved downwardly as a whole as shown in FIG. 3. Printing sheet P is moved out of roller 30 with its feeding angle regulated by pinch roller 40. Sheet P thus moves along the following path. First, its front end, then, its back end is guided by regulating member 50, while essentially at all times being in contact with the upper surface of regulating member 50. Thus, the distance between the sheet and ink jet head 60 is regulated, and characters, images and the like are printed on the surface of the sheet with the ink jet head in printing section A. Sheet P then proceeds to sheet discharging tray 90 through the pair of sheet discharging rollers 71 and 72 and sheet discharging section 80 through separater 190 for separating sheet from sheets feed roller 30.

Figure 2:
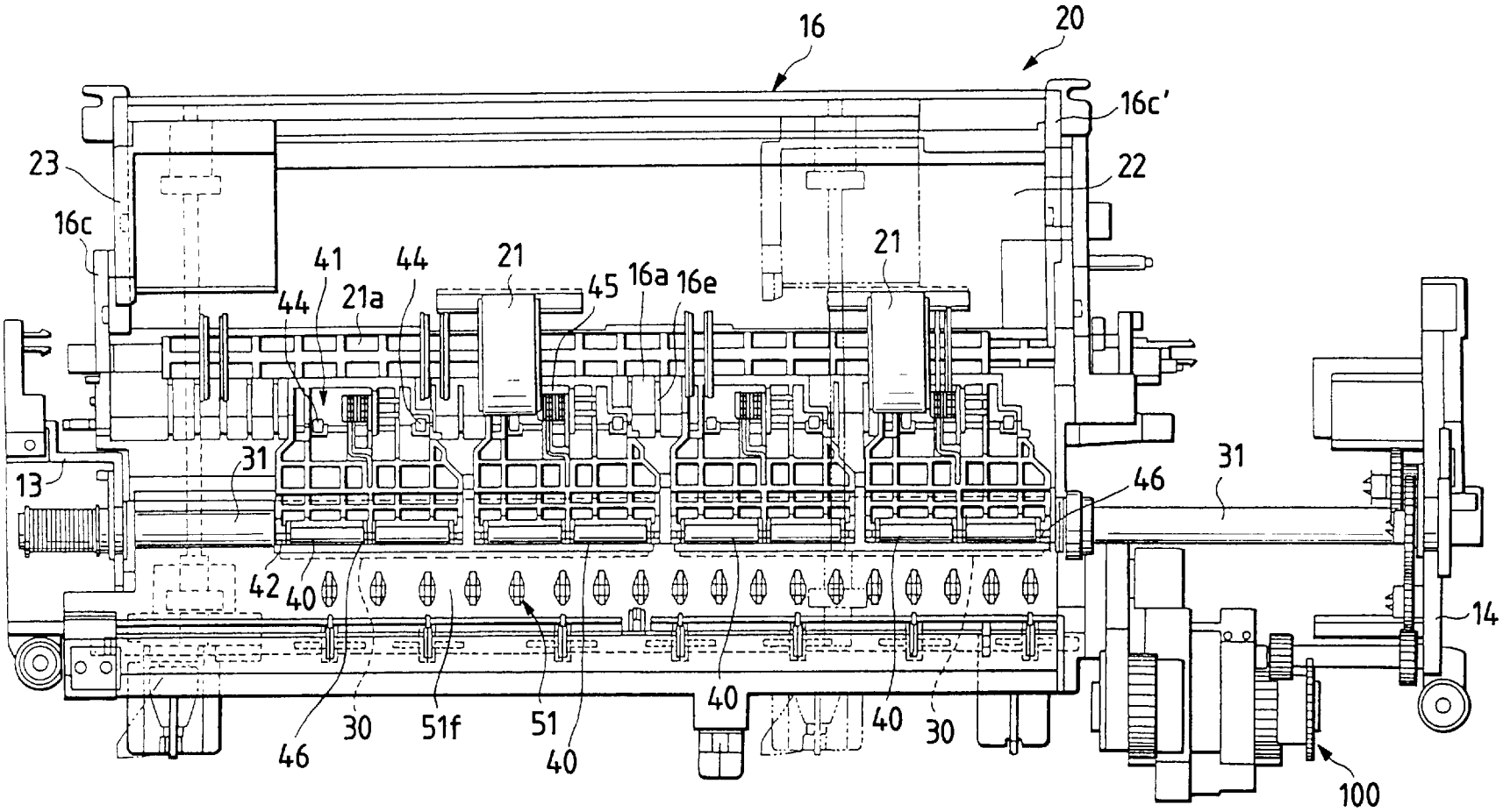
FIG. 2 is a top plan view showing certain components of the internal structure of the ink jet printer constructed in accordance with the invention.

As shown in FIGS. 1 and 2, printer body 10 includes casing 11 and a bottom frame 12 made of a metal plate which serves also as a shield plate inside casing 11. Right and left plastic side frames 13 and 14 are connected to bottom plate 12. An intermediate frame 15 is positioned between side frames 13 and 14. A sub-frame 16 is secured to frames 13, 14 and 15 at several positions. Sub-frame 16 includes a bottom plate 16*a*, which forms the lower portion of sheet passageway PP; a back plate 16*b*; and side plates 16*c* and 16*c*, which extend from the right and left of bottom plate 16*a* and back plate 16*b*. That is, bottom plate 16*a*, back plate 16*b*, and side plates 16*c* and 16*c*' are provided as a single unit. A rib-shaped sheet guide 16*e* is formed on the upper surface of bottom plate 16*a*. In a preferred embodiment intermediate frame 15 is made of metal.

Automatic sheet supplying unit 20 includes a hopper 22, an edge guide 23 and a sheet supplying tray 24. A sheet supplying roller shaft 21*a* is rotatably supported on side plates 16*c* and 16*c*' of sub-frame 16. Two sheet supplying rollers 21 are fixedly mounted on a sheet supplying roller shaft 21*a* with grooves. Each sheet supplying roller 21 is substantially D-shaped in cross-section and covered with a rubber layer. When a sheet is supplied, shaft 21*a* is rotated by a transmission mechanism (not shown), which operates in association with a drive mechanism 100.

Hopper 22 is installed in printer body 11 so that it is obliquely movable in a vertical plane (obliquely along edge guide 23). A hopper spring 25 is provided to correspond to each roller 21 and is obliquely and upwardly moved between hopper 22 and bottom plate 16*a* of sub-frame 16. A cam mechanism (not shown), which operates in association with drive mechanism 100, is mounted on side plates 16*c* and 16*c*' of subframe 16 to push down hopper 22 against the elastic forces of hopper springs 25. Hopper 22 operates as follows to supply a printing sheet. Hopper 22 is released from the cam mechanism (not shown) so that hopper springs 25 push the sheet upwardly in such a manner that the sheet is pressed against sheet supplying rollers 21. After the sheet has been supplied, hopper 22 is moved downwardly by the cam mechanism so that the pressing of the sheet against sheet supplying rollers 21 is suspended. Edge guide 23 is slidably coupled to hopper 22. Edge guide 23, as shown in FIG. 2, is to guide the left side (edge) of printing sheet P (not shown) set on hopper 22. The right side (edge) of printing sheet P is guided by the inner surface of the upper portion of side plate 16*c*'.

As shown in FIG. 1, the lower end portion of sheet supplying tray 24 is placed in an inserting piece 24*a*. Inserting piece 24*a* is inserted into an inserting hole 11*a* formed in casing 11 so that sheet supplying tray 24 is detachably mounted on printer body 10. Under this condition, sheet supplying tray 24 supports the lower surface of printing sheet P. Once printing sheets P are loaded, automatic sheet supplying mechanism 20 is ready for operation. Hopper 22 is pushed upwardly and released from the cam mechanism (not shown) so that only the uppermost of the stack of printing sheets, abutted against sheet supplying rollers 21, is delivered into sheet feed path PP.

Figure 4:
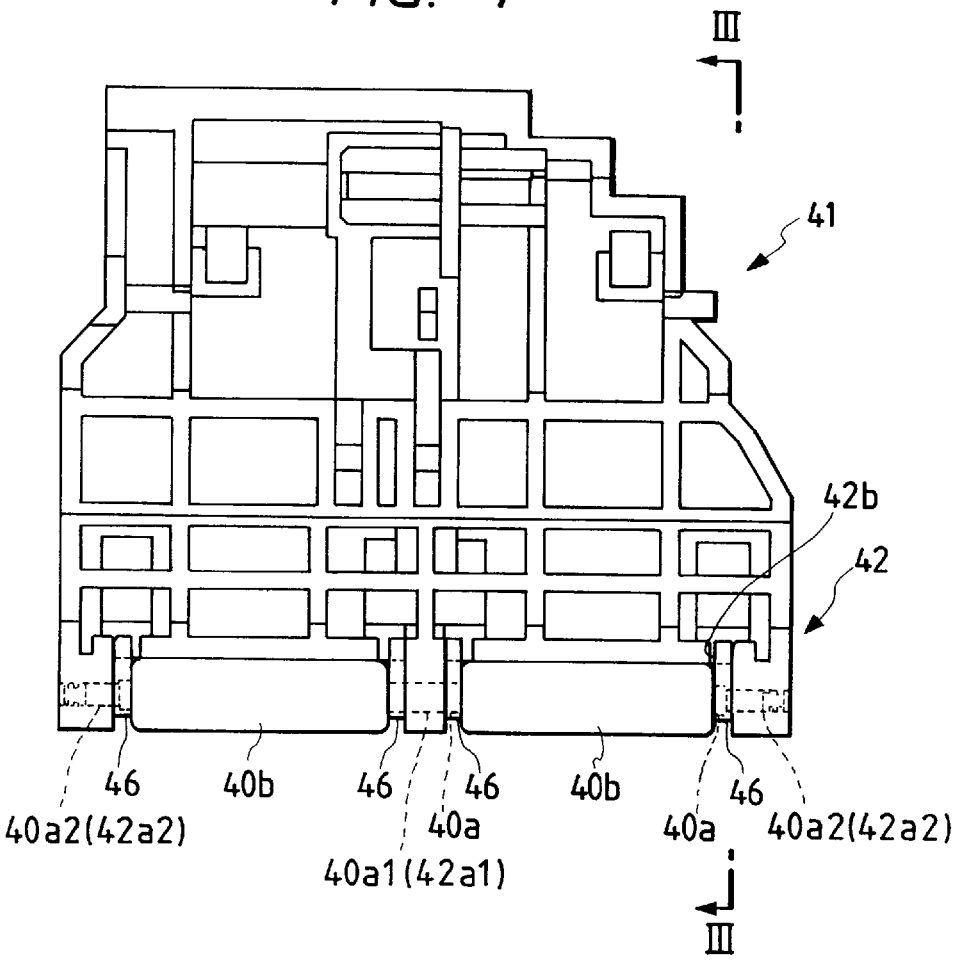
FIG. 4 is a plan view of the printer roller, holder and guide member constructed in accordance with the invention.
Figure 5:
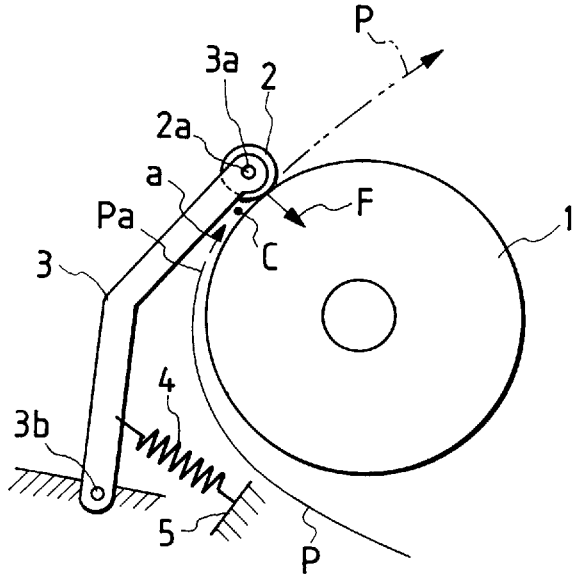
FIG. 5 PRIOR ART
FIG. 5 is a partial section side elevational view of a printer in accordance with the prior art.

Sheet feeding roller 30 is constructed with two roundrod-shaped rubber rollers which are relatively long, and fixedly mounted on sheet feeding shaft 31. Sheet feeding shaft 31 is supported by side frames 13 and 14, and driven by drive mechanism 100. During a printing operation, printing head 60 prints characters or images along a line and sheet feeding shaft 31 conveys the printing sheet as much as the space between adjacent printing lines permits. Pinch roller 40 is made of a material relatively high in wear resistance, for example, metal. As shown in FIG. 4, pinch roller 40 comprises a shaft 40*a*; and two rollers 40*b* integral with shaft 40*a*. However, although not shown, four pinch rollers 40 are provided for sheet feeding roller 30. Pinch rollers 40 are rotatably supported as shown in FIGS. 3 and 4.

A holder 41 is formed with hooks 44 and is mounted to intermediate frame 15 and is swingingly coupled to frame 15. Holder 41 acts as a supporting member for rotatably supporting pinch rollers 40. Holder 41 also serves as a sheet guide, thus forming the upper portion of sheet feed path PP.

Central portion 40*a*1 and both end portions 40*a*2 of shaft 40 of each pinch roller 40 are engaged with rectangular bearing holes 42*a*1 and 42*a*2 formed in the end portions of arms 42 of holder 41. An urging member, namely, a spring 45 is provided between holder 41 and intermediate frame 15.

The elastic force of spring 45 causes pinch roller 40 to abut against sheet feeding roller 30 at the Position a (FIG. 3). Position a is located beyond top 30*a* of sheet feeding roller 30 in the sheet feeding direction. That is, position a defines the nipping region of pinch roller 40 and sheet feeding roller 30. Holders 41 are made of a material such as synthetic resin which is not always high in wear resistance. Guide members 46 lead the front end Pa of a printing sheet P to position it between sheet feeding roller 30 and pinch roller 40.

As shown in FIGS. 3 and 4, each guide member 46 is separated from holder 41. In this manner, guide member 46 is directed from holder 41. Guide members 46 include corresponding respective engaging portions 46*a*, which engage with corresponding shafts 40*a* of pinch rollers 40, and engaging portions 46*b*, which engage with corresponding protruded pieces 42*b* extending from the end of arms 42. That is, guide members 46 are coupled to the end portions of arms 42 of holders 41 through engaging portions 46*a* and 46*b*. Because engaging portions 46*a* are engaged with shafts 40*a* of pinch rollers 40, guide members 46 are positioned with respect to sheet feeding roller 30. As shown in FIG. 4, guide members 46 are positioned on each side 40*b* of pinch roller 40 (i.e. four guide members 46 per pinch roller 40).

As shown in FIGS. 1 and 2, regulating member 50 is provided on the non-printed side of a printing sheet conveyed by sheet feeding roller 30. Regulating member 50, as shown in FIG. 2, comprises a horizontal portion 51*f* and ribs 51, which extend upwardly from horizontal portion 51*f*. More specifically, a plurality of ribs 51 are extended in a direction perpendicular to the direction of conveyance of printing sheets. Regulating member 50 is fixedly secured to bottom frame 12.

Ink jet head 60 outputs different color ink droplets to perform a color printing operation. As shown in FIG. 1, ink jet head 60 is mounted on carriage 61. Carriage 61 is supported by a guide shaft 62 and upper edge 15*a* of intermediate frame 15. More specifically, carriage 61, while being guided by guide shaft 62 and upper edge 15*a* of intermediate directly perpendicular to the surface of the drawing of FIG. 1 by a carriage 61, a monochromatic ink tank 63 and/or color ink tanks 64 are mounted so as to be arranged in a direction perpendicular to the surface of the drawing of FIG. 1.

Based on the above construction, the ink jet printer operates as follows:

(i) As the power switch of the printer is turned on, automatic sheet supplying unit 20 operates to supply a printing sheet into sheet feed path PP. In this operation, sheet feeding roller 30 is rotated by drive mechanism 100 in the direction of arrow G in FIG. 3.

(ii) As printing sheet P is moved, its front end Pa is guided by guide members 46 towards nipping region a of sheet feeding roller 30 and pinch roller 40 in the direction of arrow H as shown in FIG. 3.

(iii) When the front end Pa of sheet P enters nipping region a, the force of conveyance of sheet feeding roller 30 acts on sheet P so that the front end is held between pinch roller 40 and sheet feeding roller 30. As a result, printing sheet P is conveyed with the sheet feeding angle regulated by pinch roller 40.

(iv) The sheet conveyed by sheet feeding roller 30 is then guided by regulating member 50, while printing head 60 jets ink to print characters, images and the like on the printing sheet. Thereafter, the sheet is discharged. That is, it is conveyed through the pair of sheet discharging rollers 71 and 72 and sheet discharging section 80 onto sheet discharging tray 90.

The ink jet printer of the above construction includes the following advantages. Guide members 46 are not integral with holders 41. Rather, guide members 46 form a separate and discrete element of the printer. In particular, holder 41 serves as the supporting members for pinch rollers 40, while guide members 46 are positioned by shafts 40*a* of pinch rollers 40. Hence, even when bearings 42*a*1 and 42*a*2 of pinch rollers 40, which support shaft 40*a* are worn and end portion 42*c* (cf. FIG. 3) of arm 42 of holder 41 is displaced towards sheet feeding roller 30, guide member 46 is less affected by the displacement. In other words, even when bearings 42*a*1 and 42*a*2 of holder 41 are worn, shaft 40*b* of pinch roller 40 is not displaced until pinch roller 40 is worn. As a result, guide member 46, positioned by shaft 40*a* of pinch roller 40, remains essentially unchanged in position with respect to sheet feeding roller 30 even if the bearings of holder 41 are worn.

Therefore, distance C between guide member 46 and sheet feeding roller 30 may be accurately maintained. Hence, a printing sheet can be smoothly conveyed irrespective of the thickness thereof.

As is apparent from the above description, by determining a suitable value of force F, which is the force applied by pinch roller 40 to sheet feeding roller 30 with the aid of urging member 45 (hereinafter referred to as "a pressing force F", when applicable), the sheet feeding operation can be achieved positively and accurately, with a result that the resultant print is fine in print quality.

Accordingly, a printer is provided which comprises: a sheet feeding roller which is adapted to convey a printing sheet; a pinch roller having a shaft and is adapted to press the printing sheet against the sheet feeding roller; a supporting member which rotatably supports the pinch roller through the shaft thereof; an urging member which applies a pressing force through the supporting member to the pinch roller; and a guide member which is adapted to lead the front edge of the printing sheet to the nipping region of the sheet feeding roller and the pinch roller. Hence, the sheet is conveyed in such a manner that its front end is guided by the guide member and held between the sheet feeding roller and the pinch roller.

While one preferred embodiment of the invention has been disclosed herein, it will be obvious to those skilled in the art that various changes and modifications may be made to the construction of the printer without departing from the invention. For example, (1) guide member 46 is mounted on the end of holder 41 by engaging portion 46*b* being engaged with protruded piece 42*b* of holder 41. Hence, in the case when bearings 42*a*1 and 42*a*2 of holder 41 are worn and holder 41 is displaced towards sheet feeding roller 30, the sheet feeding operation could be adversely affected. However, if the printer is modified so that engaging portion 46*b* of guide member 46 is supported by an additional and independent part (such as a supporting member (not shown) mounted on frame 15) distinct from holder 41, then the sheet feeding operation is smoothly achieved; (2) pinch roller 40 may be replaced with a driving roller; and (3) holder 41 may be designed so that it does not also serve as a sheet guide.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printer for imprinting information onto recording media, comprising:

at least one sheet feeding roller for conveying a recording medium through the printer;

at least one supporting member pivotably mounted for displacement relative to said sheet feeding roller;

a roller shaft rotatable supported by said supporting member;

at least one pinch roller mounted on said roller shaft, said at least one pinch roller for pressing the recording medium against said sheet feeding roller, a nipping region being substantially formed where said sheet feeding roller meets said pinch roller; and at least one guide member for guiding the recording medium to said nipping region without regard for minor variation in the relative position of said roller shaft, said at least one guide member being articulaby, supportably mounted between said supporting member and said roller shaft.

2. The printer of claim 1, wherein said guide member is mounted to said shaft of said pinch roller.

3. The printer of claim 1, further including an urging member for applying a pressing force through said supporting member to said pinch roller.

4. The printer of claim 1, wherein said at least one supporting member includes four supporting members.

5. The printer of claim 1, wherein said at least one pinch roller includes four pinch rollers.

6. The printer of claim 1, wherein said guide member is mounted on said supporting member.

7. The printer of claim 1, wherein said at least one sheet feeding roller includes two sheet feeding rollers.

8. The printer of claim 3, wherein said urging member is a spring.

* * * * *